US011591738B2

(12) United States Patent
Hettinger et al.

(10) Patent No.: US 11,591,738 B2
(45) Date of Patent: Feb. 28, 2023

(54) OPTIMIZING SOAK TIME IN A WASHING MACHINE APPLIANCE

(71) Applicant: Haier US Appliance Solutions, Inc., Wilmington, DE (US)

(72) Inventors: Stephen Edward Hettinger, Louisville, KY (US); Ryan Ellis Leonard, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 77 days.

(21) Appl. No.: 16/911,962

(22) Filed: Jun. 25, 2020

(65) Prior Publication Data

US 2021/0404104 A1 Dec. 30, 2021

(51) Int. Cl.

| | |
|---|---|
| ***D06F 34/06*** | (2020.01) |
| ***D06F 34/18*** | (2020.01) |
| ***D06F 37/30*** | (2020.01) |
| ***D06F 33/36*** | (2020.01) |
| ***D06F 37/20*** | (2006.01) |
| ***D06F 33/47*** | (2020.01) |

(Continued)

(52) U.S. Cl.

CPC ..... *D06F 34/06* (2020.02); *D06F 21/06* (2013.01); *D06F 33/36* (2020.02); *D06F 33/47* (2020.02); *D06F 34/18* (2020.02); *D06F 37/206* (2013.01); *D06F 37/30* (2013.01); *D06F 2103/04* (2020.02); *D06F 2103/38* (2020.02); *D06F 2103/70* (2020.02); *D06F 2105/54* (2020.02); *D06F 2105/62* (2020.02)

(58) Field of Classification Search

CPC ..... D06F 33/47; D06F 34/06

See application file for complete search history.

(56) References Cited

U.S. PATENT DOCUMENTS

| | | | |
|---|---|---|---|
| 9,765,465 | B2 | 9/2017 | Im |
| 2014/0202216 | A1 | 7/2014 | Kim |

(Continued)

FOREIGN PATENT DOCUMENTS

| | | | |
|---|---|---|---|
| CN | 104264416 | B | 9/2016 |
| KR | 100192411 | B1 | 6/1999 |

(Continued)

OTHER PUBLICATIONS

KR20150041855A Machine Translation (Year: 2015).*
KR20070121174A Machine Translation (Year: 2007).*
KR20060029860A Machine Translation (Year: 2006).*

*Primary Examiner* — Spencer E. Bell
(74) *Attorney, Agent, or Firm* — Dority & Manning, P.A.

(57) ABSTRACT

A method of operating a washing machine appliance is provided. The washing machine appliance includes a rotatable basket and a motor configured to drive the rotatable basket. The method includes sensing an attribute of articles in the basket. The method also includes determining a pause duration for an agitation operation based at least in part on the sensed attribute of the articles in the basket. The method further includes performing the agitation operation for a period of time. The agitation operation includes activating a motor of the washing machine appliance to agitate the articles within the basket for an agitation duration and deactivating the motor of the washing machine appliance for the pause duration. The period of time is equal to the sum of the agitation duration and the pause duration.

18 Claims, 3 Drawing Sheets

(51) Int. Cl.

| | |
|---|---|
| ***D06F 105/54*** | (2020.01) |
| ***D06F 103/04*** | (2020.01) |
| ***D06F 103/38*** | (2020.01) |
| ***D06F 103/70*** | (2020.01) |
| ***D06F 105/62*** | (2020.01) |
| ***D06F 21/06*** | (2006.01) |

(56) References Cited

U.S. PATENT DOCUMENTS

2015/0308034 A1* 10/2015 Cavarretta ..... D06F 58/34
62/238.7
2016/0130740 A1* 5/2016 Im ..... D06F 37/266
68/17 R

FOREIGN PATENT DOCUMENTS

KR 100315806 B1 12/2001
KR 20060029860 A * 4/2006
KR 20070121174 A * 12/2007
KR 20150041855 A * 4/2015

* cited by examiner

OPTIMIZING SOAK TIME IN A WASHING MACHINE APPLIANCE

FIELD OF THE INVENTION

The present subject matter relates generally to washing machine appliances and methods for determining an optimal soak time for articles therein during an agitation operation based at least in part on a sensed attribute of the articles.

BACKGROUND OF THE INVENTION

Washing machine appliances generally include a tub with a basket rotatably positioned within the tub. Articles to be washed, such as clothes, are placed in the machine's basket. A motor may be mechanically coupled to the basket and/or an agitation element disposed within the basket, such as by a direct drive or a belt and pulley, for rotation of the basket and/or agitation element. At various points in the operation of the washing machine, the basket and/or agitation element can rotate to move articles within the basket to facilitate washing. For example, the basket and/or agitation element may be rotated during a rinse cycle of the washing machine appliance to facilitate distributing rinse fluid evenly on articles within the basket.

As another example, the basket and/or agitation element may be rotated during an agitation operation of the washing machine appliance. Such rotation during the agitation operation may include oscillation, e.g., rotating in a first direction, stopping, then rotating in the opposite direction. When oscillating the basket and/or agitation element, the heat of the drive motor may rise.

Accordingly, a washing machine appliance with features for providing one or more pause times or soak times during an agitation operation would be useful. In particular, a washing machine appliance with features for determining an optimal pause time for adequate heat dissipation without unduly extending the total time period of the agitation operation would be useful.

BRIEF DESCRIPTION OF THE INVENTION

Aspects and advantages of the invention will be set forth in part in the following description, or may be obvious from the description, or may be learned through practice of the invention.

In one aspect of the present disclosure, a method of operating a washing machine appliance is provided. The washing machine appliance includes a rotatable basket and a motor configured to drive the rotatable basket. The method includes detecting a weight of articles in the basket and comparing an elapsed time since completion of the most recent previous wash cycle of the washing machine appliance to a time threshold. The method also includes performing an agitation operation which has a pause duration. The pause duration of the agitation operation is based on the detected weight of the articles in the basket and the comparison of the elapsed time since completion of the most recent previous wash cycle of the washing machine appliance completed to the time threshold.

In another aspect of the present disclosure, a method of operating a washing machine appliance is provided. The washing machine appliance includes a rotatable basket and a motor configured to drive the rotatable basket. The method includes sensing an attribute of articles in the basket. The method also includes determining a pause duration for an agitation operation based at least in part on the sensed attribute of the articles in the basket. The method further includes performing the agitation operation for a period of time. The agitation operation includes activating a motor of the washing machine appliance to agitate the articles within the basket for an agitation duration and deactivating the motor of the washing machine appliance for the pause duration. The period of time is equal to the sum of the agitation duration and the pause duration.

In another aspect of the present disclosure, a washing machine appliance is provided. The washing machine appliance includes a rotatable basket, a motor configured to drive the rotatable basket, and a controller. The controller is in operative communication with the motor. The controller is configured for detecting a weight of articles in the basket and comparing an elapsed time since completion of the most recent previous wash cycle of the washing machine appliance to a time threshold. The controller is also configured for performing an agitation operation which has a pause duration. The pause duration of the agitation operation is based on the detected weight of the articles in the basket and the comparison of the elapsed time since completion of the most recent previous wash cycle of the washing machine appliance completed to the time threshold.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
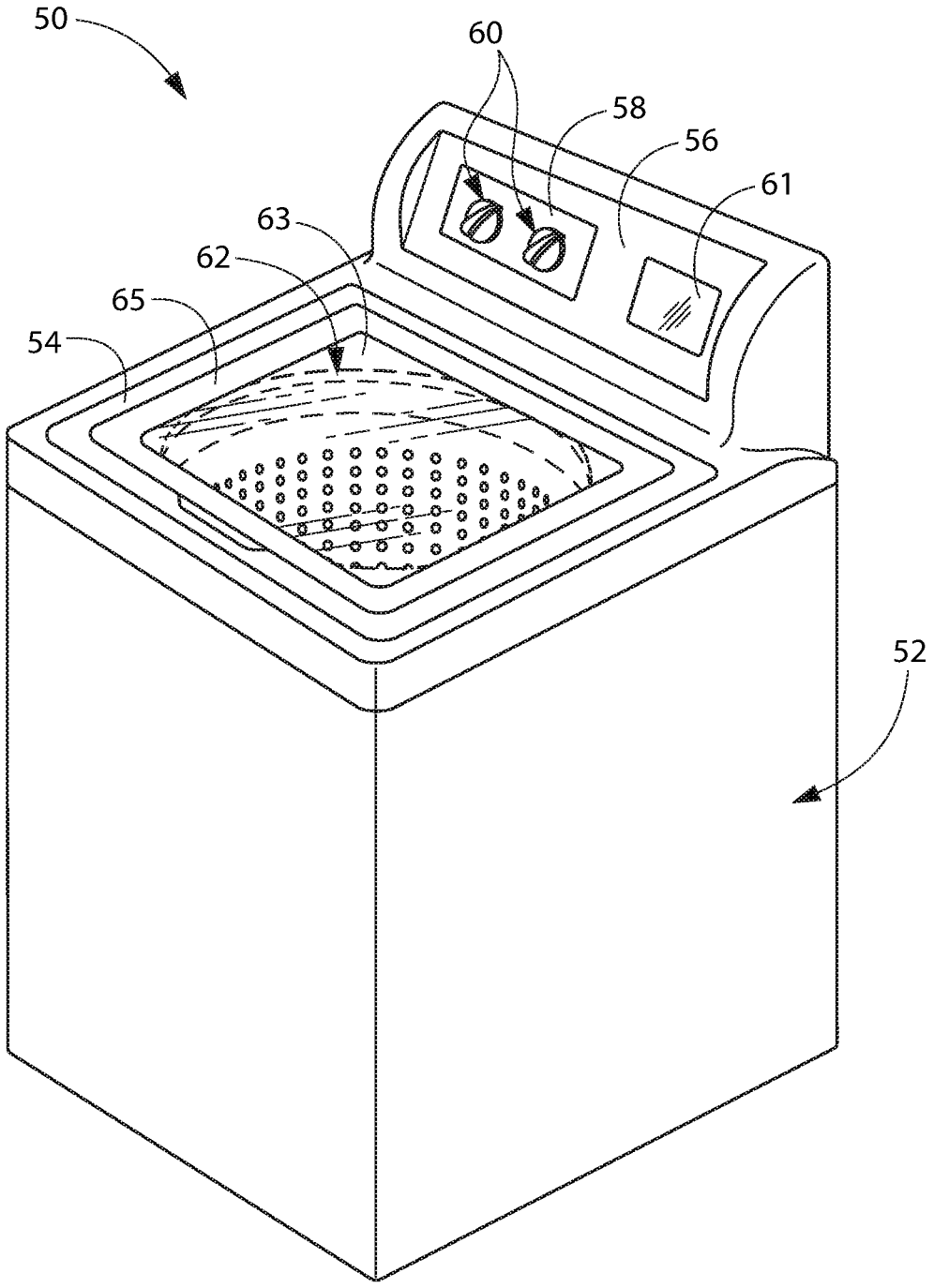
FIG. 1 provides a perspective view of a laundry appliance in accordance with one or more example embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

As used herein, the terms "articles," "clothing," or "laundry" include but need not be limited to fabrics, textiles, garments, linens, papers, or other items which may be cleaned and/or treated in a washing machine appliance. Furthermore, the term "load" or "laundry load" refers to the combination of clothing that may be washed together in a washing machine appliance or dried together in a dryer appliance (e.g., clothes dryer) and may include a mixture of different or similar articles of clothing of different or similar types and kinds of fabrics, textiles, garments and linens within a particular laundering process.

FIG. 1 is a perspective view of a washing machine appliance 50 according to an exemplary embodiment of the present subject matter. As may be seen in FIG. 1, washing machine appliance 50 includes a cabinet 52 and a cover 54. A backsplash 56 extends from cover 54, and a control panel 58, including a plurality of input selectors 60, is coupled to backsplash 56.

Control panel 58 and input selectors 60 collectively form a user interface input for operator selection of machine cycles and features, and in one embodiment, a display 61 indicates selected features, a countdown timer, and/or other items of interest to machine users. It should be appreciated, however, that in other exemplary embodiments, the control panel 58, input selectors 60, and display 61, may have any other suitable configuration. For example, in other exemplary embodiments, one or more of the input selectors 60 may be configured as manual "push-button" input selectors, or alternatively may be configured as a touchscreen on, e.g., display 61.

A lid 62 is mounted to cover 54 and is rotatable between an open position (not shown) facilitating access to a tub, also referred to as a wash tub, 64 (FIG. 2) located within cabinet 52 and a closed position (shown in FIG. 1) forming an enclosure over tub 64. Lid 62 in exemplary embodiment includes a transparent panel 63, which may be formed of, for example, glass, plastic, or any other suitable material. The transparency of the panel 63 allows users to see through the panel 63, and into the tub 64 when the lid 62 is in the closed position. In some embodiments, the panel 63 may itself generally form the lid 62. In other embodiments, the lid 62 may include the panel 63 and a frame 65 surrounding and encasing the panel 63. Alternatively, panel 63 need not be transparent.

Figure 2:
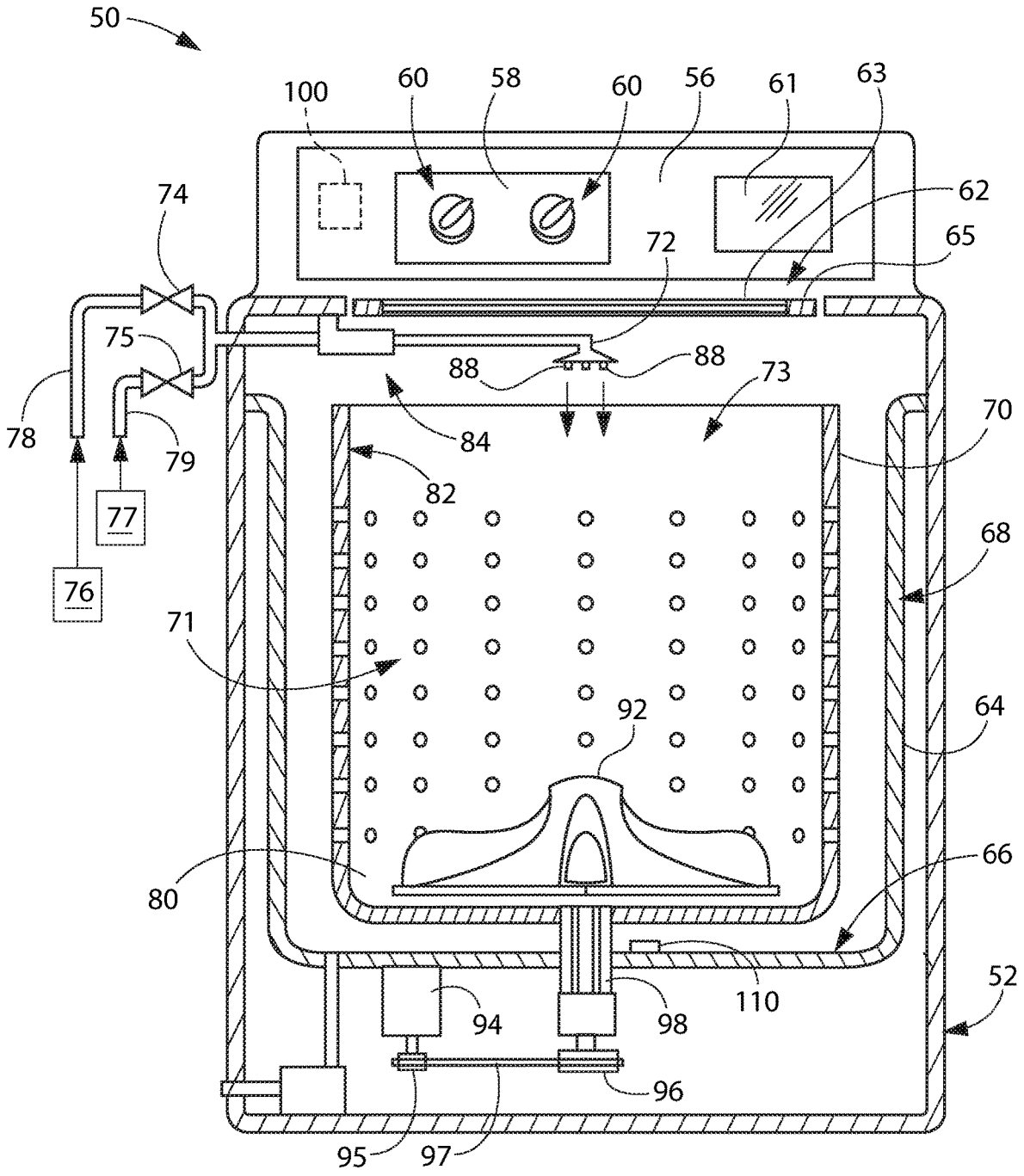
FIG. 2 provides a front, section view of the exemplary laundry appliance of FIG. 1.

FIG. 2 provides a front, cross-section view of the exemplary washing machine appliance 50 of FIG. 1. As may be seen in FIG. 2, tub 64 includes a bottom wall 66 and a sidewall 68. A wash drum or basket 70 is rotatably mounted within tub 64. In particular, basket 70 is rotatable about a vertical axis V. Thus, washing machine appliance is generally referred to as a vertical axis washing machine appliance. Basket 70 defines a wash chamber 73 for receipt of articles for washing and extends, e.g., vertically, between a bottom portion 80 and a top portion 82. Basket 70 includes a plurality of openings or perforations 71 therein to facilitate fluid communication between an interior of basket 70 and tub 64.

A nozzle 72 is configured for flowing a liquid into tub 64. In particular, nozzle 72 may be positioned at or adjacent to top portion 82 of basket 70. Nozzle 72 may be in fluid communication with one or more water sources 76, 77 in order to direct liquid (e.g. water) into tub 64 and/or onto articles within chamber 73 of basket 70. Nozzle 72 may further include apertures 88 through which water may be sprayed into the tub 64. Apertures 88 may, for example, be tubes extending from the nozzles 72 as illustrated, or simply holes defined in the nozzles 72 or any other suitable openings through which water may be sprayed. Nozzle 72 may additionally include other openings, holes, etc. (not shown) through which water may be flowed, i.e., sprayed or poured, into the tub 64.

Various valves may regulate the flow of fluid through nozzle 72. For example, a flow regulator may be provided to control a flow of hot and/or cold water into the wash chamber of washing machine appliance 50. For the embodiment depicted, the flow regulator includes a hot water valve 74 and a cold water valve 75. The hot and cold water valves 74, 75 are utilized to flow hot water and cold water, respectively, therethrough. Each valve 74, 75 can selectively adjust to a closed position in order to terminate or obstruct the flow of fluid therethrough to nozzle 72. The hot water valve 74 may be in fluid communication with a hot water source 76, which may be external to the washing machine appliance 50. The cold water valve 75 may be in fluid communication with a cold water source 77, which may be external to the washing machine appliance 50. The cold water source 77 may, for example, be a commercial water supply, while the hot water source 76 may be, for example, a water heater. Such water sources 76, 77 may supply water to the appliance 50 through the respective valves 74, 75. A hot water conduit 78 and a cold water conduit 79 may supply hot and cold water, respectively, from the sources 76, 77 through the respective valves 74, 75 and to the nozzle 72.

An additive dispenser 84 may additionally be provided for directing a wash additive, such as detergent, bleach, liquid fabric softener, etc., into the tub 64. For example, dispenser 84 may be in fluid communication with nozzle 72 such that water flowing through nozzle 72 flows through dispenser 84, mixing with wash additive at a desired time during operation to form a liquid or wash fluid, before being flowed into tub 64. For the embodiment depicted, nozzle 72 is a separate downstream component from dispenser 84. In other exemplary embodiments, however, nozzle 72 and dispenser 84 may be integral, with a portion of dispenser 84 serving as the nozzle 72, or alternatively dispenser 84 may be in fluid communication with only one of hot water valve 74 or cold water valve 75. In still other exemplary embodiments, the washing machine appliance 50 may not include a dispenser, in which case a user may add one or more wash additives directly to wash chamber 73. A pump assembly 90 (shown schematically in FIG. 2) is located beneath tub 64 and basket 70 for gravity assisted flow to drain tub 64.

In some embodiments, for example as illustrated in FIG. 2, an agitation element 92 may be provided and may be oriented to rotate about the vertical direction V. As illustrated in FIG. 2, the basket 70 and agitation element 92 are driven by a motor 94, such as an induction motor, which is mechanically coupled to the basket 70. The motor may be mechanically coupled to the basket 70, e.g., via a drive pulley 95, a basket pulley 96, and a belt 97 as illustrated in FIG. 2. When the motor 94 is activated, the motor 94 rotates the drive pulley 95 and such rotation is transferred via the belt 97 to the basket pulley 96 which is joined to a motor output shaft 98. The basket pulley 96 may be integrally joined to the motor output shaft 98 or may be otherwise joined in any suitable manner. As motor output shaft 98 is rotated, basket 70 and agitation element 92 are operated for rotatable movement within tub 64, e.g., about vertical axis V. In other embodiments, the belt 97 may be directly connected to the basket 70, e.g., in a horizontal axis washing machine appliance. In additional exemplary embodiments, the motor may be mechanically coupled to the basket 70 and/or agitation element 92 without any belts or pulleys using a direct drive assembly. Various other forms of mechanical coupling may also be provided, such as via a mode shifter which selectively transfers rotation from the motor 94 to the basket 70 or the agitator 92. Such forms of mechanical coupling, e.g., a direct drive and/or mode shifter, are understood by those of skill in the art and, as such, are not illustrated in detail.

Various sensors may additionally be included in the washing machine appliance 50. For example, a pressure sensor 110 may be positioned in the tub 64 as illustrated or, alternatively, may be remotely mounted in another location within the appliance 50 and be operationally connected to tub 64 by a hose (not shown). Any suitable pressure sensor 110, such as an electronic sensor, a manometer, or another suitable gauge or sensor, may be utilized. The pressure sensor 110 may generally measure the pressure of water in the tub 64. This pressure can then be utilized to estimate the height or amount of water in the tub 64. Additionally, a suitable speed sensor can be connected to the motor 94, such as to the output shaft 98 thereof, to measure speed and indicate operation of the motor 94. Other suitable sensors, such as temperature sensors, water/moisture sensors, etc., may additionally be provided in the washing machine appliance 50.

Operation of washing machine appliance 50 is controlled by a processing device or controller 100, that is operatively coupled to the input selectors 60 located on washing machine backsplash 56 (shown in FIG. 1) for user manipulation to select washing machine cycles and features. Controller 100 may further be operatively coupled to various other components of appliance 50, such as the flow regulator (including valves 74, 75), motor 94, pressure sensor 110, speed sensor, other suitable sensors, etc. In response to user manipulation of the input selectors 60, controller 100 may operate the various components of washing machine appliance 50 to execute selected machine cycles and features.

Controller 100 is a "processing device" or "controller" and may be embodied as described herein. As used herein, "processing device" or "controller" may refer to one or more microprocessors, microcontroller, application-specific integrated circuits (ASICS), or semiconductor devices and is not restricted necessarily to a single element. The controller 100 may be programmed to operate dryer appliance 50 by executing instructions stored in memory. The controller may include, or be associated with, one or more memory elements such as for example, RAM, ROM, or electrically erasable, programmable read only memory (EEPROM). For example, the instructions may be software or any set of instructions that when executed by the processing device, cause the processing device to perform operations. Controller 100 can include one or more processor(s) and associated memory device(s) configured to perform a variety of computer-implemented functions and/or instructions (e.g. performing the methods, steps, calculations and the like and storing relevant data as disclosed herein). It should be noted that controllers 100 as disclosed herein are capable of and may be operable to perform any methods and associated method steps as disclosed herein.

While described in the context of specific embodiments of washing machine appliance 50, using the teachings disclosed herein it will be understood that washing machine appliance 50 is provided by way of example only. Other laundry appliances having different configurations (such as horizontal-axis washing machine appliances, or various clothes dryer appliances), different appearances, and/or different features may also be utilized with the present subject matter as well.

Embodiments of the present disclosure include methods of operating a washing machine appliance and/or determining a pause duration for an agitation operation of a washing machine appliance. One example of such embodiments is the method 300 illustrated in FIG. 3. Method 300 can be used to operate any suitable washing machine appliance, such as washing machine appliance 50 (FIG. 1), for example. In some embodiments, method 300 may be programmed into and implemented by controller 100 (FIG. 2) of washing machine appliance 50.

Figure 3:
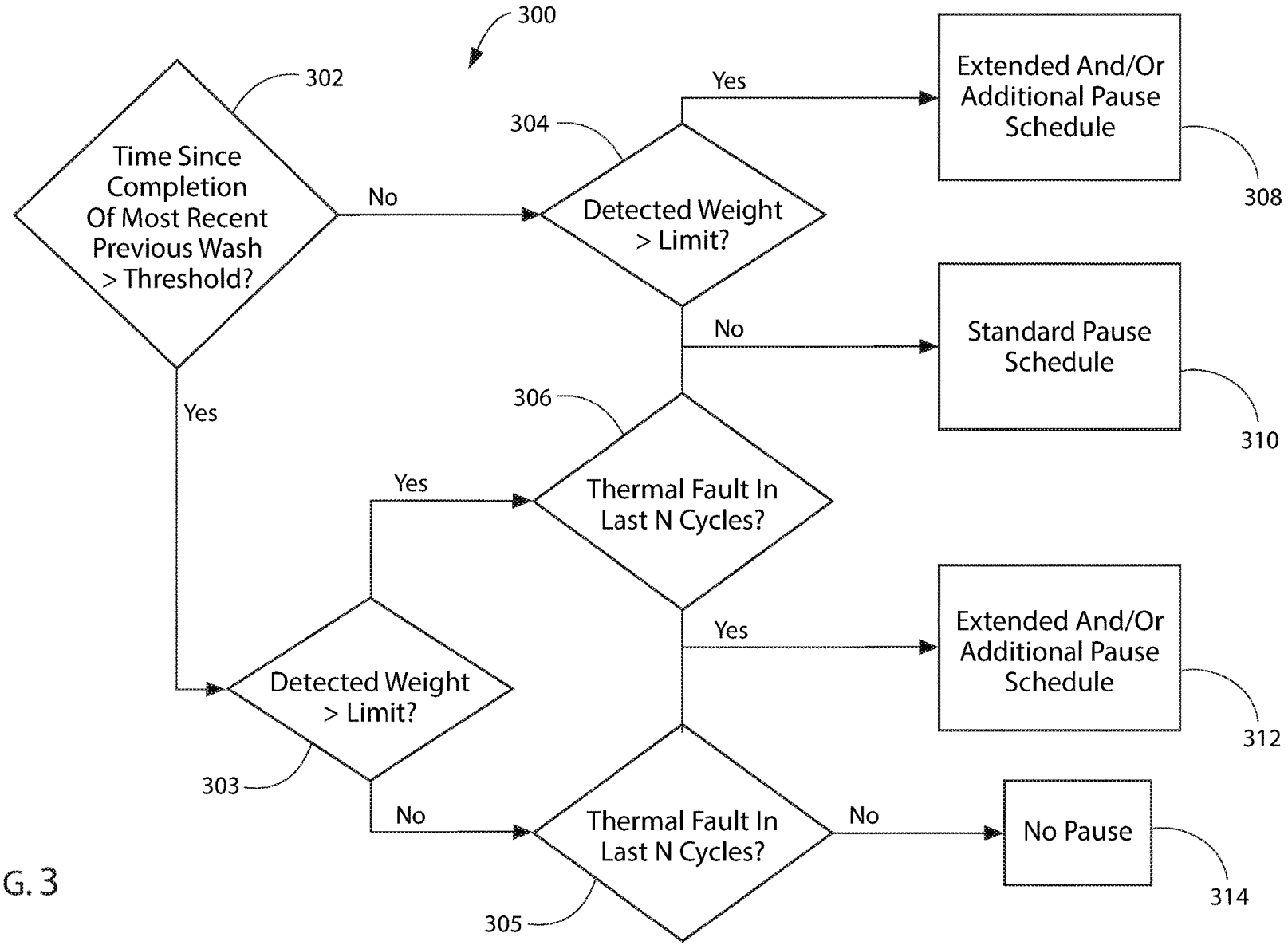
FIG. 3 provides a flow chart illustrating a method of operating a washing machine appliance in accordance with one or more example embodiments of the present disclosure.

As shown in FIG. 3, the method 300 may include a step 302 of comparing an elapsed time since completion of the most recent previous wash cycle of the washing machine appliance to a time threshold. It should be understood that while there may be multiple previous wash cycles, there can be only one most recent previous wash cycle, such that the term "the most recent previous wash cycle" has inherent antecedent basis. The time threshold may be, for example, a cooldown time during which heat may dissipate from the motor 94. For instance, the motor 94 may be at or about, e.g., within plus or minus ten degrees C. of, room temperature once the time threshold has elapsed following the most recent wash cycle. Those of ordinary skill in the art will understand room temperature as referring to a temperature between about 20° C. and about 30° C.

Method 300 may also include and/or controller 100 may also be configured for sensing an attribute of articles in the basket 70, such as detecting a weight of articles in the basket 70. At least some embodiments may further include determining a pause duration for an agitation operation based at least in part on the sensed attribute of the articles in the basket, such as determining the pause duration based on the detected weight. Additionally, the method may further include and/or the controller may further be configured for performing the agitation operation including the determined pause duration. The pause duration may be determined based on the attribute, e.g., weight, of the articles in the basket, as well as the elapsed time since the last wash cycle and/or the occurrence of a thermal fault within the last N cycles.

In various embodiments, the agitation operation may include one or more pauses. The agitation operation may take place or be performed over a period of time. The period of time of the agitation operation may begin at the first activation of the motor 94 during the current wash cycle, such as the first activation of the motor 94 at agitation speed (as opposed to, e.g., spin speed), and/or at the first activation of the motor 94 following a fill operation, e.g., flowing a wash volume of water into the tub 64. The motor 94 may then be operated at the agitation speed for a first agitation time or duration. The period of time of the agitation operation may end when the motor 94, e.g., is deactivated, either at the end of the first agitation duration or a second or other subsequent agitation duration. In some embodiments, the motor 94 is not activated at the agitation speed again throughout the remainder of the wash cycle after the period of time of the agitation operation. In other embodiments, the wash cycle may include more than one agitation operation, wherein successive agitation operations are separated by intervening operations, such as one or more of a fill operation, a drain operation, etc. Thus, in various embodiments, the end of the period of time of the agitation operation may occur when the motor 94 is deactivated at the end of the first agitation duration, when the motor 94 is deactivated at the end of a second agitation duration which is separated chronologically from the first agitation duration only by a single continuous pause duration, or when the motor 94 is deactivated at the end of an other subsequent agitation duration which is separated chronologically from the first agitation duration only by one or more pause durations and one or more intervening, e.g., second, third, etc., agitation durations. Accordingly, the period of time of the agitation operation may include and consist of at least one agitation duration. Further, when the agitation operation includes a pause, the period of time of the agitation operation may include and consist of at least two agitation durations separated by the one or more pauses.

During the pause duration, the motor 94 is deactivated, e.g., is not operating or rotating. Further, the washing machine appliance 50 is generally at rest during the pause duration, e.g., the valves 74 and 75 are not opened, no pumps are activated, etc. In various embodiments, the pause duration may be the duration of a single pause during the agitation operation, or may be a total duration of multiple pauses during the agitation operation.

In some embodiments, e.g., as illustrated at steps 303 and 304 in FIG. 3, the method 300 may include determining whether the washing machine appliance is overloaded, e.g., whether the detected weight of the articles in the basket is greater than a weight limit. The weight limit may be a maximum weight of articles that can be rotated, e.g., agitated and/or oscillated, within the basket 70 while maintaining an acceptable heat margin in the motor 94. For example, an ultimate heat or heat limit of the motor 94 may be about 145° C., and the acceptable margin may be at least about 5° C., e.g., corresponding to a maximum temperature of the motor 94 during operation, such as during an agitation operation, of the washing machine appliance 50 of about 140° C. Further, in some embodiments, the heat margin may be about 10° C. or more. Thus, as will be described in more detail below, the pause duration for the agitation operation may be determined based at least in part on whether the detected weight of the articles in the basket 70 is greater than the limit.

In some embodiments, e.g., as illustrated in FIG. 3, the comparison of the elapsed time since completion of the most recent previous wash cycle of the washing machine appliance to the time threshold at step 302 and the comparison of the detected weight of articles in the basket to the weight limit at step 303 or step 304 may lead to a selection of a pause duration for the agitation operation. For example, the pause duration may be one of a standard or default pause duration, e.g., at 310 in FIG. 3, a pause duration including extended and/or additional pauses, e.g., at 308 or 312 in FIG. 3, or a cycle profile without pauses, e.g., a pause duration of zero, such as is illustrated at 314 in FIG. 3. The standard or default pause duration may be shorter than the extended pause duration. The extended and/or additional pause schedule at 308 or 312 may include lengthening the time of the or each pause in the standard pause schedule, or may include adding additional pauses to the agitation operation, or both. Thus, an "extended pause schedule" is used herein to include any pause schedule where the pause duration is greater than the pause duration in the standard or default pause schedule. As mentioned above, each of the standard duration and the extended/additional duration may include a single pause during the agitation operation or a total of multiple pauses during the agitation operation. Thus, for example, the standard pause duration may include a single pause of a first time length, and in such embodiments the extended pause schedule may include a single pause of a second time length greater than the first time length and/or a second pause which is not included in the standard pause schedule.

In some embodiments, the method 300 may further include and/or the controller may further be configured for determining whether a thermal overload fault occurred within a number N of previous cycles, e.g., as illustrated at steps 305 and/or 306 in FIG. 3. In such embodiments, the pause duration of the agitation operation may further be based on whether a thermal overload occurred within the number N previous cycles. The thermal overload fault may occur or be logged (e.g., stored in a memory of the controller 100) when a temperature of the motor 94 exceeds the heat margin. Additionally, the controller 100 and/or method 300 may include a counter, and the counter may be incremented at the completion of each wash cycle. In such embodiments, any thermal overload faults may be cleared after N cycles. For example, the number N may be between about ten cycles and about twenty cycles, such as about fifteen cycles. Thus, in an example where the number N is twenty cycles, a thermal fault which is logged during cycle one will be cleared after cycle twenty-one.

Checking for a previous thermal overload fault within the last N cycles may provide an indirect indication of an overloaded basket and/or that the motor has not been idle long enough to fully cool down. For example, users who wash a lot of laundry, e.g., heavy users who overload the basket and/or run several wash cycles back-to-back, may do so in every wash cycle or most wash cycles. Thus, for example, even if a current load is not overloaded and/or a current wash cycle is performed after the cooldown time, in the case of a heavy user the extended pause schedule may still be useful for providing heat dissipation time in the current cycle and/or the next cycle (such as by providing a lower starting temperature at the beginning of the next cycle which may occur prior to the cooldown time in the case of a heavy user). In such examples, the occurrence of a thermal overload fault within the last N cycles may be an indication of a heavy user.

Referring again to FIG. 3, when the determination at step 302 is positive, e.g., when the elapsed time since completion of the most recent previous wash cycle is greater than the time threshold, the method 300 may continue at step 303 of determining whether the detected weight (or other sensed attribute in additional embodiments) is above a limit.

When the determination at step 303 is negative, e.g., when the detected weight of the articles in the basket is less than or equal to the weight limit, the method 300 then proceeds to step 305 and from step 305 to one of performing the agitation operation with an extended and/or additional pause schedule, e.g., setting the pause duration of the agitation operation to an extended pause schedule, at step 312, or performing the agitation operation without pauses, e.g., setting the pause duration of the agitation operation to zero, at step 314.

The determination of whether the method 300 proceeds from steps 303 and 305 to step 312 or step 314 may be determined based on whether a thermal overload fault occurred within a number N of previous cycles, e.g., as illustrated at 305 in FIG. 3. When the determination at 305 in FIG. 3 is positive, e.g., when the thermal overload fault has occurred within the number N of previous cycles, the method 300 may proceed to set the pause schedule to the extended and/or additional pause schedule at step 312 and perform the agitation operation according to the extended pause schedule. When the determination at 305 in FIG. 3 is negative, e.g., when no thermal overload fault occurred within the number N of previous cycles, the method 300 may proceed to set the pause duration of the agitation operation to zero at step 314 and perform the agitation operation without pauses.

When the determination at step 303 is positive, e.g., when the detected weight of the articles in the basket is greater than the weight limit, the method 300 the proceeds to step 306 and from step 306 to one of performing the agitation operation with a standard pause schedule, e.g., setting the pause duration of the agitation operation to a standard or default pause schedule at step 310, or performing the agitation operation with an extended and/or additional pause schedule, e.g., setting the pause duration of the agitation operation to an extended pause schedule, at step 312.

The determination of whether the method 300 proceeds from steps 303 and 306 to step 310 or step 312 may be determined based on whether a thermal overload fault occurred within a number N of previous cycles, e.g., as illustrated at 306 in FIG. 3. When the determination at 306 in FIG. 3 is positive, e.g., when the thermal overload fault has occurred within the number N of previous cycles, the method 300 may proceed to set the pause schedule to the extended and/or additional pause schedule at step 312 and perform the agitation operation accordingly. When the determination at 306 in FIG. 3 is negative, e.g., when no thermal overload fault occurred within the number N of previous cycles, the method 300 may proceed to set the pause duration of the agitation operation to the standard or default pause schedule at step 310 and perform the agitation operation with the standard or default pause schedule.

Returning to step 302 in FIG. 3, when the determination at step 302 is negative, e.g., when the cooldown time has not elapsed and/or when the elapsed time since completion of the most recent previous wash cycle is less than or equal to the time threshold, the method 300 may continue at step 304 of determining whether the detected weight (or other sensed attribute in additional embodiments) is above a limit. When the determination at step 304 is negative, e.g., when the detected weight of the articles in the basket is less than or equal to the weight limit, the method 300 then proceeds to set the pause duration of the agitation operation to the standard or default pause schedule at step 310 and perform the agitation operation with the standard or default pause schedule. When the determination at step 304 is positive, e.g., when the detected weight of the articles in the basket is greater than the weight limit, the method 300 the proceeds to set the pause schedule to the extended and/or additional pause schedule at step 312 and perform the agitation operation accordingly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a washing machine appliance, the washing machine appliance comprising a rotatable basket and a motor configured to drive the rotatable basket, the method comprising:

detecting a weight of articles in the basket;

comparing an elapsed time since completion of the most recent previous wash cycle of the washing machine appliance to a time threshold;

determining whether a thermal overload fault occurred within a number of previous cycles; and performing an agitation operation including a pause duration, wherein the washing machine appliance is at rest during the pause duration and no pumps of the washing machine appliance are activated during the pause duration, and wherein the pause duration of the agitation operation is based on the detected weight of the articles in the basket, whether the thermal overload occurred within the number of previous cycles, and the comparison of the elapsed time since completion of the most recent previous wash cycle of the washing machine appliance completed to the time threshold.

2. The method of claim 1, wherein the number of previous cycles is about fifteen previous cycles.

3. The method of claim 1, wherein the pause duration of the agitation operation comprises a duration of a single pause during the agitation operation.

4. The method of claim 1, wherein the pause duration of the agitation operation comprises a total duration of multiple pauses during the agitation operation.

5. The method of claim 1, wherein the pause duration of the agitation operation is set to a default pause schedule when the elapsed time since completion of the most recent previous wash cycle is less than or equal to the time threshold.

6. The method of claim 1, wherein the pause duration of the agitation operation is set to a default pause schedule when the elapsed time since completion of the most recent previous wash cycle is less than or equal to the time threshold and the detected weight of the articles in the basket is less than or equal to a weight limit.

7. The method of claim 1, wherein the pause duration of the agitation operation is set to an extended pause schedule when the elapsed time since completion of the most recent previous wash cycle is less than or equal to the time threshold and the detected weight of the articles in the basket is greater than a weight limit.

8. The method of claim 1, wherein the pause duration of the agitation operation is set to an extended pause schedule when the elapsed time since completion of the most recent previous wash cycle is greater than the time threshold and the thermal overload fault occurred within the number of previous cycles.

9. The method of claim 1, wherein the pause duration of the agitation operation is set to a default pause schedule when the elapsed time since completion of the most recent previous wash cycle is greater than the time threshold, the detected weight of the articles in the basket is greater than a weight limit, and the thermal overload fault occurred within the number of previous cycles.

10. The method of claim 1, wherein the pause duration of the agitation operation is set to zero when the elapsed time since completion of the most recent previous wash cycle is greater than the time threshold, the detected weight of the articles in the basket is less than or equal to a weight limit, and no thermal overload fault occurred within the number of previous cycles.

11. A method of operating a washing machine appliance, the washing machine appliance comprising a rotatable basket and a motor configured to drive the rotatable basket, the method comprising:

sensing an attribute of articles in the basket;

determining whether a thermal overload fault occurred within a number of previous cycles;

determining a pause duration for an agitation operation based at least in part on the sensed attribute of the articles in the basket and whether the thermal overload occurred within the number of previous cycles;

performing the agitation operation for a period of time, the agitation operation comprising activating a motor of the washing machine appliance to agitate the articles within the basket for an agitation duration and deactivating the motor of the washing machine appliance for the pause duration, wherein the washing machine appliance is at rest during the pause duration and no pumps of the washing machine appliance are activated during the pause duration, and wherein the period of time is equal to the sum of the agitation duration and the pause duration.

12. The method of claim 11, wherein the sensed attribute of the articles in the basket is a weight of the articles in the basket.

13. The method of claim 11, wherein determining the pause duration for the agitation operation further comprises comparing an elapsed time since completion of the most recent previous wash cycle of the washing machine appliance to a time threshold and determining the pause duration based on the sensed attribute of the articles, whether the thermal overload occurred within the number of previous cycles, and the comparison of the elapsed time since completion of the most recent previous wash cycle of the washing machine appliance to the time threshold.

14. The method of claim 11, wherein the agitation operation comprises activating the motor of the washing machine appliance to agitate the articles within the basket for a first agitation time, deactivating the motor of the washing machine appliance for the pause duration after the first agitation time, and activating the motor of the washing machine appliance to agitate the articles within the basket for a second agitation time after the pause duration, wherein the agitation duration is equal to the sum of the first agitation time and the second agitation time, and wherein the pause duration of the agitation operation comprises a duration of a single pause during the agitation operation.

15. The method of claim 11, wherein the agitation operation comprises multiple agitation times alternating with multiple pause times, wherein the agitation duration is equal to the sum of the multiple agitation times, and wherein the pause duration of the agitation operation comprises a total duration of the multiple pause times.

16. A washing machine appliance, comprising:

a rotatable basket;

a motor configured to drive the rotatable basket; and a controller in operative communication with the motor, the controller configured for:

detecting a weight of articles in the basket;

comparing an elapsed time since completion of the most recent previous wash cycle of the washing machine appliance to a time threshold;

determining whether a thermal overload fault occurred within a number of previous cycles; and performing an agitation operation including a pause duration, wherein the washing machine appliance is at rest during the pause duration and no pumps of the washing machine appliance are activated during the pause duration, and wherein the pause duration of the agitation operation is based on the detected weight of the articles in the basket, whether the thermal overload occurred within the number of previous cycles, and the comparison of the elapsed time since completion of the most recent previous wash cycle of the washing machine appliance completed to the time threshold.

17. The washing machine appliance of claim 16, wherein the motor is directly coupled to the basket.

18. The washing machine appliance of claim 16, wherein the motor is coupled to the basket via a belt and pulley.

* * * * *